United States Patent [19]

Orbach

[11] Patent Number: 4,944,415

[45] Date of Patent: Jul. 31, 1990

[54] BOTTLE SUPPORT APPARATUS

[76] Inventor: Max A. Orbach, 473 FDR Dr., New York, N.Y. 10002

[21] Appl. No.: 317,876

[22] Filed: Mar. 2, 1989

[51] Int. Cl.[5] ..... A47B 73/00

[52] U.S. Cl. ..... 211/75; 211/181

[58] Field of Search ..... 211/75, 74, 106, 181

[56] References Cited

U.S. PATENT DOCUMENTS

| | | | |
|---|---|---|---|
| 85,208 | 12/1868 | Burrow | 211/74 |
| 218,616 | 9/1970 | Owen, Jr. | 211/74 X |
| D. 233,723 | 11/1974 | Gutierrez | 211/74 X |
| 379,152 | 3/1888 | Clemens | 211/106 |
| 1,233,001 | 7/1917 | Tuohimaa | 211/106 |
| 3,746,179 | 7/1973 | Paumgardhen | 211/75 |

FOREIGN PATENT DOCUMENTS

| | | | |
|---|---|---|---|
| 641091 | 5/1962 | Canada | 211/59.1 |

*Primary Examiner*—Alvin C. Chin-Shue
*Assistant Examiner*—Sarah A. Lechok
*Attorney, Agent, or Firm*—Wolder, Gross & Bondell

[57] ABSTRACT

An apparatus for supporting a bottle in an inclined position comprises a neck embracing portion in the form of a substantially closed loop and a generally curved bottle body supporting portion. The portions are each adapted to be mounted in a spaced-apart relationship whereby a bottle may be retained in a slanted position thereby. The resulting structures may be mounted either alone or in combination upon suitable supports to create wine racks of a variety of configurations and capacities.

1 Claim, 5 Drawing Sheets

FIG. 1
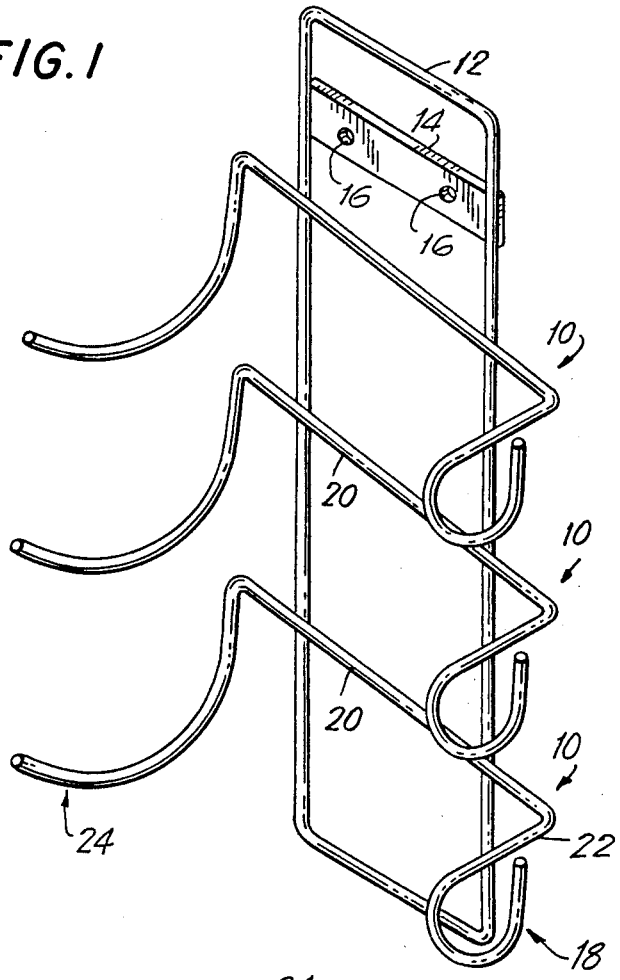
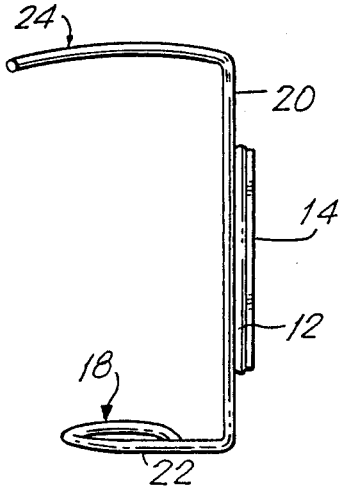
FIG. 2

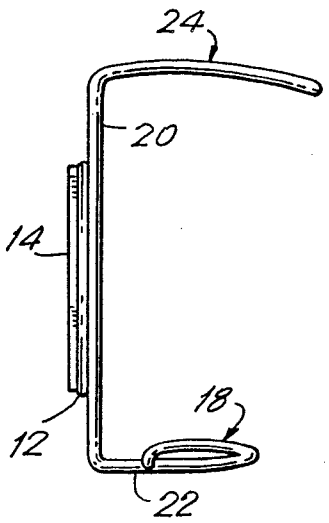
FIG. 6
FIG. 5
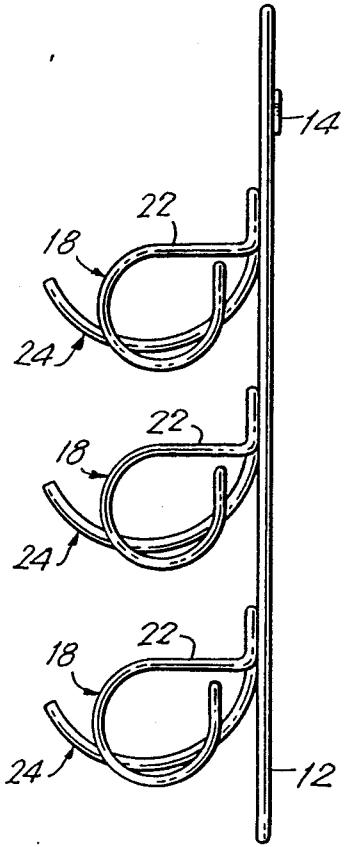

BOTTLE SUPPORT APPARATUS

The present invention relates to a new and improved apparatus for the support of bottles and similarly shaped objects in an inclined or horizontal position, and, in particular, to such an apparatus which may be utilized as a rack for wine bottles and the like.

It is well recognized that, for the proper storage of wine and similar beverages, and especially such products bottled with a natural cork stopper, the bottle be maintained in an inclined position whereby the cork material remains in contact with the bottle contents. Such wetting of the cork prevents its drying out and decomposition, thus maintaining the integrity of the bottle seal over an extended period of time.

Towards this end, a variety of structures and racks have been designed. Much of these structures, however, are relatively ornate and/or complex in construction, and do not lend themselves to utilization in a variety of locations or mounting arrangements. In addition, the methods of bottle support utilized often permits the bottles to be easily displayed, resulting in breakage and resultant damage and possible injury.

It is accordingly a purpose of the present invention to provide a wine rack or similar type structure for the support of bottles in an inclined or horizontal position and which may be utilized in a variety of settings and which is inexpensive and efficient to manufacture.

Yet another purpose of the present invention is to provide a wine rack which securely supports the bottle in the inclined position to avoid inadvertent slippage of the bottle from the rack.

In accordance with the above and other objects, the apparatus of the present invention comprises a bottle positioning mechanism having a generally closed loop portion adapted and dimensioned to embrace and support the neck of a bottle and a portion adapted to embrace and support the main body portion of the bottle at a location near the bottle bottom. The bottle-support portions are adapted to be mounted in a spaced-apart relationship, and may be joined together by an intermediate portion. The resulting structure may be affixed to a wall or the like, or may be mounted to an appropriate positioning element, which itself may be adapted to be mounted on a horizontal surface, such as a table top or shelf, or against a vertical surface, such as a wall. The individual bottle-supporting structures may be arranged in an array supported by the mounting unit so that a plurality of bottles may be stored. In an especially preferred embodiment of the invention, the bottle support and intermediate element may be formed of a continuous wire-like element, allowing efficiencies in manufacture to be recognized.

A greater understanding of the present invention will be accomplished upon consideration of the following description of preferred, but nonetheless illustrative embodiments of the invention when taken in conjunction with the annexed drawings, wherein FIG. 1 is a perspective view of a first embodiment of the invention adapted to be mounted to a wall or similar vertical surface;

FIG. 2 is a top plan view of the embodiment of FIG. 1;

FIG. 5 is a front elevation view;

FIG. 6 is a bottom plan view of the embodiment;

Figure 4:
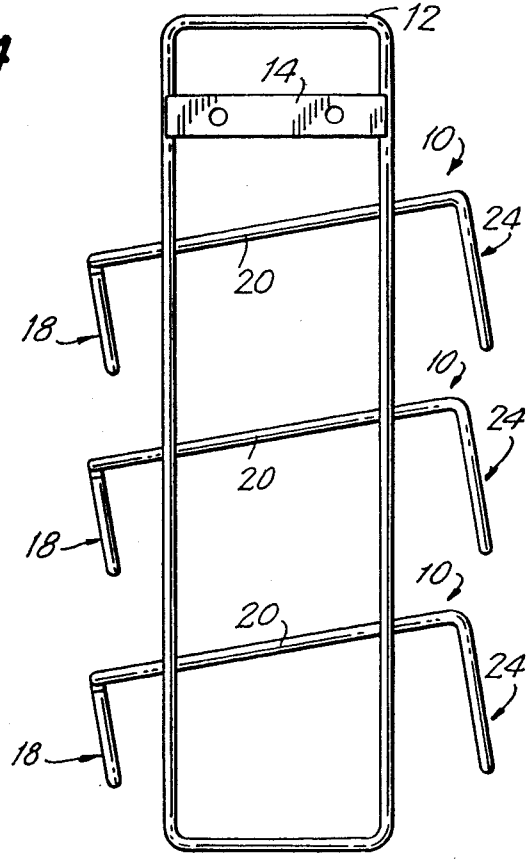
FIG. 4 is a side elevation view.

Referring initially to FIGS. 1 through 6, a first embodiment of the invention comprises a plurality of individual bottle-supporting units 10 mounted to a vertically oriented frame or spine 12. Frame 12 is provided with a mounting piece 14 having a pair of through-bores 16 to allow the structures to be mounted to a vertical surface, such as a wall.

Each of the individual bottle-supporting units 10 includes a first, generally closed looped neck-supporting portion 18, sized to support the neck portion of a bottle within the interior opening of the loop. The loop may be of any shape sufficient to embrace the bottle neck, and may include an open portion, so long as the open portion is of a size insufficient to prevent passage of the bottle neck therethrough. This neck supporting portion is joined to central support element portion 20 by the horizontal portion 22 of the loop.

Affixed to the distal end of central portion 20 is rear bottle body support portion 24, which is shown as an arcuate segment whose radius is chosen to generally coincide with the radius of the bottle size intended to be supported. Other shapes for the bottle body support portion may be alternatively utilized, including polygonal and complex curves. In each case the portion is sufficiently deep to prevent the bottle from rolling off the portion. As used herein, the term "generally curved" is intended to encompass all of the foregoing. In an especially preferred form, elements 18 through 24 may be advantageously formed from a continuous segment of wire-like element, chosen from an appropriate material, such as brass, steel, or other material chosen for its decorative, as well as structural, properties. Each of the formed bottle supporting units 10 may be tack-welded or otherwise affixed to the frame 12, which may be similarly formed from the wire, or from any other appropriate material For example, frame 12 may take the form of a rectangular block, formed of wood, plastic or the like. In such a case, the neck and bottle body support portions 18, 24 may be affixed directly to the frame without use of central portion 20 by use of threaded elements or the like.

Figure 3:
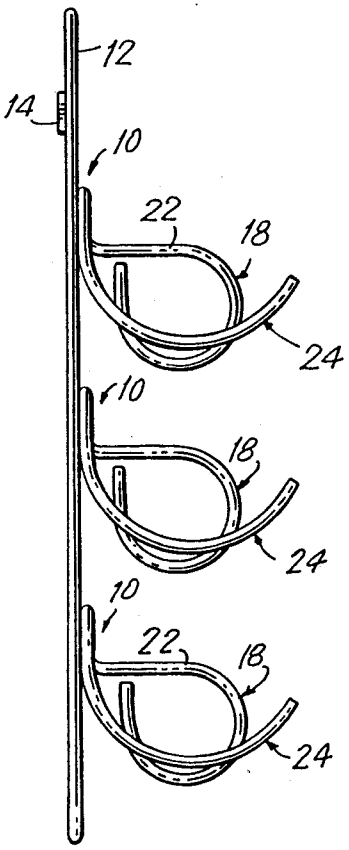
FIG. 3 is a rear elevation view of the embodiment.

As may be seen in FIGS. 3 and 4, the alignment of neck and rear support portions 18 and 24 is such that an inserted bottle will lie centered in the support portions in an inclined position, with the neck titled downwardly from the horizontal.

Figure 7:
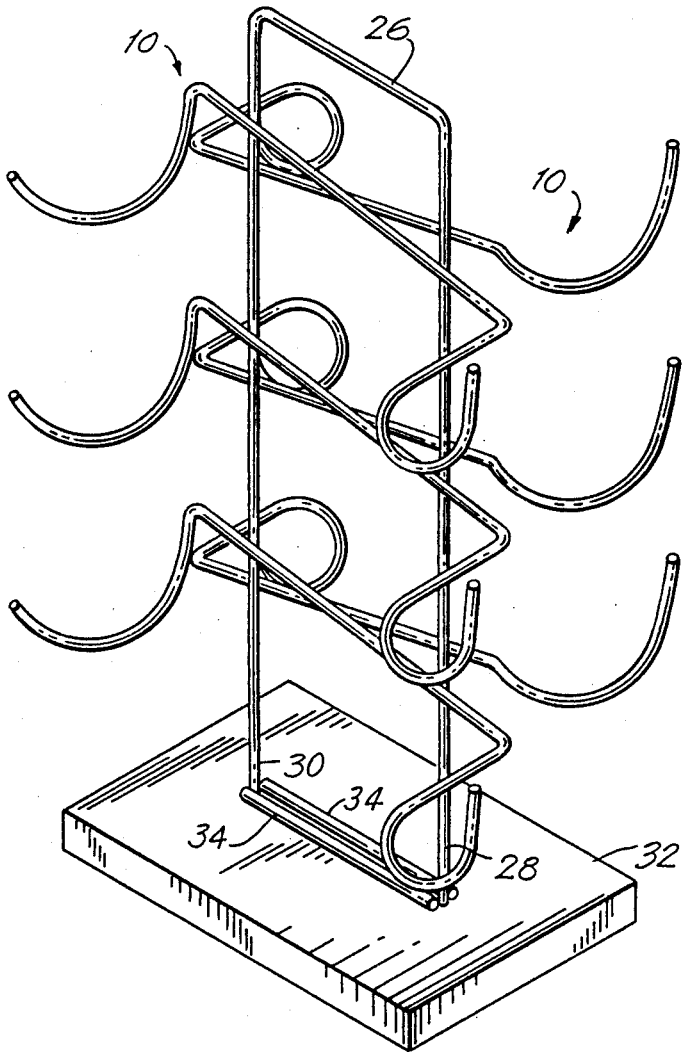
FIG. 7 is a perspective view of a second embodiment of the invention.

As shown in FIG. 7, the present invention may also be formed in an embodiment which may be placed upon a horizontal, rather than a vertical, surface. As seen therein, the individual bottle-supporting units 10 may be placed on both sides of a central frame or spine 26. The construction of the bottle-supporting units 10, and their mounting to central spine 26, is in the same manner as with the previous embodiment.

Central spine 26, which is in the shape of an inverted U, has its lower arm ends 28, 30 extending into appropriately-sized bores in base plate 32, which is sized to support the spine 26 and attached bottle-supporting units 10. A pair of stop members 34 are fastened to extend between the arm ends 28, 30, and serve both to limit the travel of the ends into the base 32 and to provide additional rigidity for the unit. A pair of self-locking washers or the like (not shown) may be installed on the spine arm ends portion projecting through the bottom of base 32 to prevent the spine from being removed from the base. The washers may be in recessed counterbores located on the bottom surface of the base.

Figure 8:
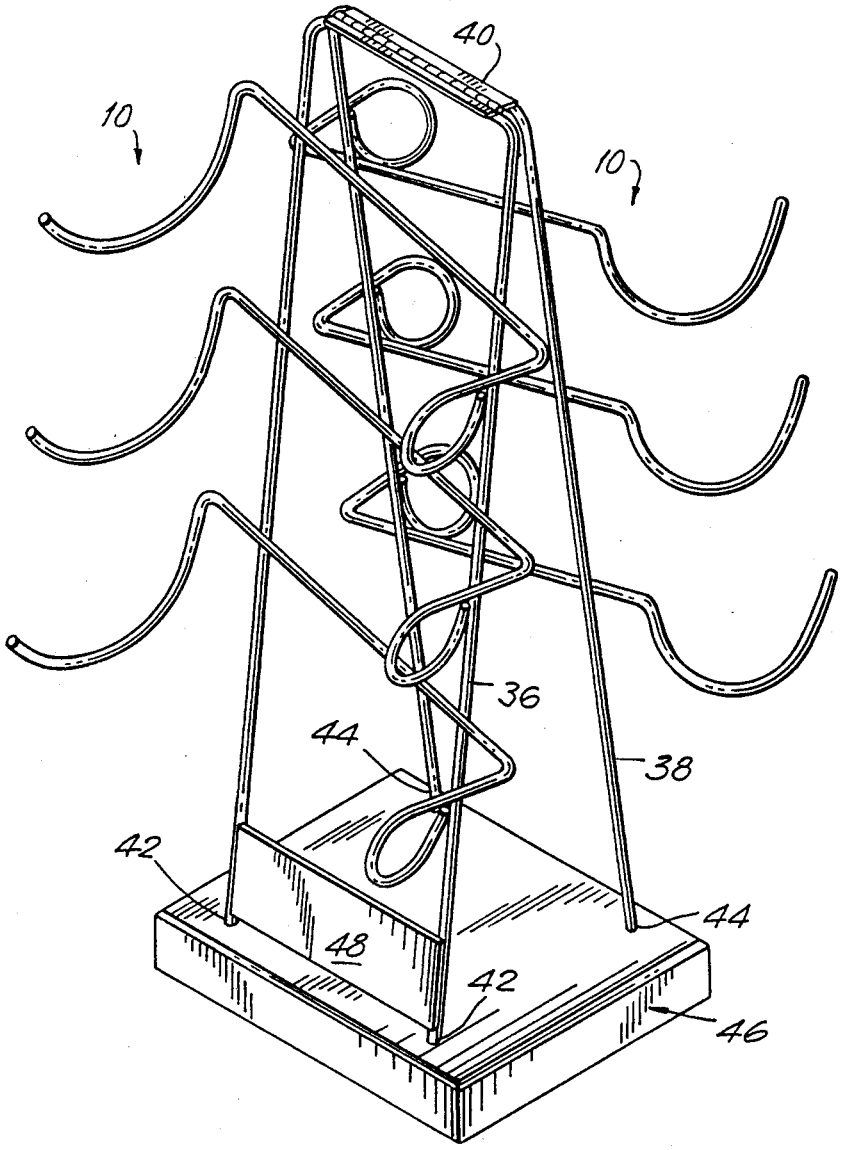
FIG. 8 is a perspective view of a third embodiment of the invention.

As shown in FIG. 8, the present invention may further be embodied in an apparatus having a pair of attached central spines 36, 38 mounted together in an inverted V configuration to provide additional stability. As may be seen in that Figure, the spines 36, 38 are joined together at their top, horizontal portions by hinge means 40. Each of the spines bear, on its outwardly directed side, a plurality of bottle-supporting units 10 as in the previous embodiments. Means 40 may be formed of an appropriate material, such as a metal compatible with the material from which the spines are constructed, and may be affixed thereto by any conventional means, including tack-welding or soldering. Alternatively, other means of joining the spines together may be utilized, including clamps, clips or the like, which may be pivotable or rigid. The lower ends 42, 44 of the spines 36, 38 are inserted in mating bores in base 46, the bores being angled as required to accept the bias of the spines. The bores may advantageously extend only a portion of the distance through the base 46, with the spine ends simply being inserted therein to rest on the bore bottoms, thus allowing the apparatus to be assembled and disassembled as may be required. A transverse brace 48 extends between the ends 24 of spine 36 proximate its lower end to both enhance rigidity and allow the placement of identifying or personalizing indicia upon the apparatus. Once again, the plate 48 may be of any material appropriate and consistent with the material of the spines, and may be affixed thereto in any appropriate means.

I claim:

1. An apparatus for supporting a plurality of bottles in a slanted position, comprising a mounting frame including a pair of spines each in an inverted U-shape having a pair of parallel arms joined by an upper horizontal portion, said spines being pivotly mounted together at said upper horizontal portions, the arms thereof being supported in a spaced-apart position by a base, each of said spines having a plurality of bottle support units affixed thereto in a spaced-apart, parallel relationship, each of said bottle support units comprising a neck-embracing, substantially closed loop portion supported by a horizontally-extending arm, a generally curved bottle body supporting portion and a central portion joining said arm and body supporting portion in a spaced-apart relationship whereby a bottle may be retained in a slanted position thereby, each of said bottle support units being formed of a continuous length of a wire-like material.

* * * * *